United States Patent [19]

Ruger et al.

[11] Patent Number: 4,593,487

[45] Date of Patent: Jun. 10, 1986

[54] LATCH ARRANGEMENT FOR PISTOL SPRING STRUT

[75] Inventors: William B. Ruger, Croydon, N.H.; Roy L. Melcher, Stratford, Conn.

[73] Assignee: Sturm, Ruger & Company, Inc., Southport, Conn.

[21] Appl. No.: 716,731

[22] Filed: Mar. 27, 1985

[51] Int. Cl.[4] ..... F41C 27/00; F41C 25/06

[52] U.S. Cl. ..... 42/7

[58] Field of Search ..... 42/7, 69 B, 75 A, 75 C

[56] References Cited

U.S. PATENT DOCUMENTS

| | | | |
|---|---|---|---|
| 1,410,266 | 3/1922 | Pedersen | 42/7 |
| 2,117,826 | 5/1938 | Seidel | 42/7 |
| 2,846,925 | 8/1958 | Norman | 42/69 B |
| 3,069,976 | 12/1962 | Stevens, Jr. | 42/7 |

FOREIGN PATENT DOCUMENTS

| | | | |
|---|---|---|---|
| 1664 | of 1909 | United Kingdom | 42/7 |

*Primary Examiner*—Charles T. Jordan

*Attorney, Agent, or Firm*—Pennie & Edmonds

[57] ABSTRACT

The pistol handle has a recess for housing a mainspring housing which is also a lanyard loop body and hammer strut unit in a releasable catch arrangement. The lanyard loop body, hammer strut, and mainspring are telescopically aligned and are withdrawn from the pistol as a unitized system during disassembly. Connector means between the loop body and strut are operative only during disassembly to prevent separation of the loop body and strut upon their removal from the pistol handle. The unit is secured in the handle recess through a bayonet joint and the unit may be turned and removed only when the magazine has been previously withdrawn.

4 Claims, 11 Drawing Figures

LATCH ARRANGEMENT FOR PISTOL SPRING STRUT

BACKGROUND OF THE INVENTION

Prior arrangements for mounting the mainspring and mainspring housing of a pistol generally have the lower end of the mainspring housing held in the handle frame by the use of pins passing through the frame and strut. Generally, these pins pass laterally through the handle frame below the mainspring and the mainspring strut. When these pins are removed for disassembly of the pistol, the mainspring can fly out of the bottom of the pistol with great force, with possible loss of the separate mainspring of the mechanism.

SUMMARY OF THE INVENTION

Broadly, the invention comprises a pistol handle recess for housing a mainspring housing which is also a lanyard loop body and hammer strut unit in a releasable catch arrangement. The lanyard loop body, hammer strut, and mainspring are telescopically aligned and are withdrawn from the pistol as a unitized system during disassembly. Connector means between the loop body and strut are operative only during disassembly to prevent separation of loop body and strut upon their removal from the pistol handle. The unit is secured in the handle recess through a bayonet joint and the unit may be turned and removed only when the magazine has been previously withdrawn.

DESCRIPTION OF THE PREFERRED EMBODIMENT

Figure 1:
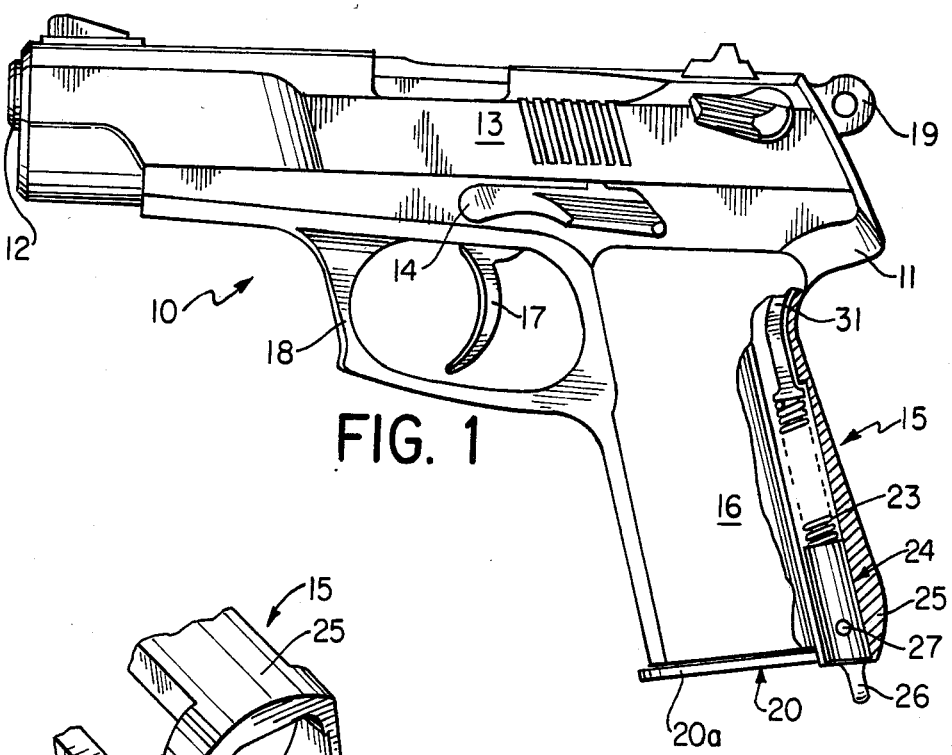
FIG. 1 is a side elevational view of the pistol of the invention.
Figure 2:
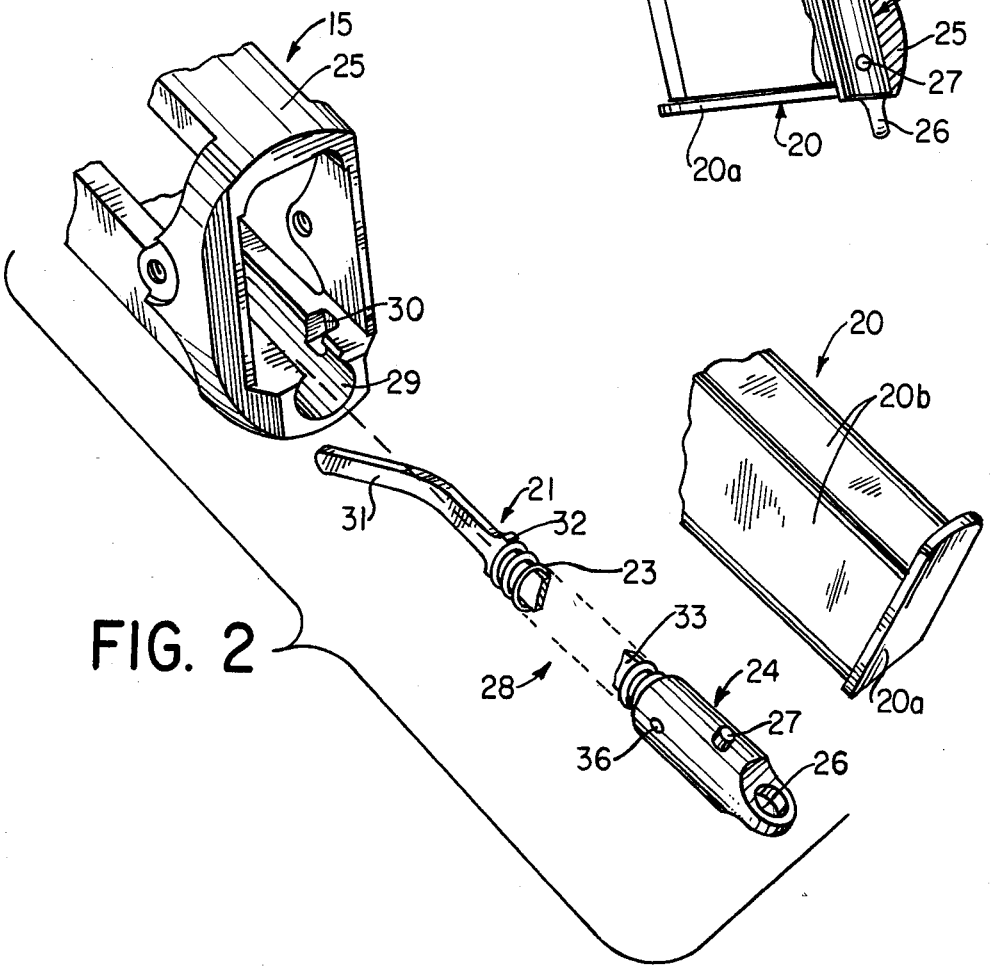
FIG. 2 is a perspective view of the pistol handle butt portion and showing the magazine and the loop body and strut in a withdrawn position.
Figure 3:
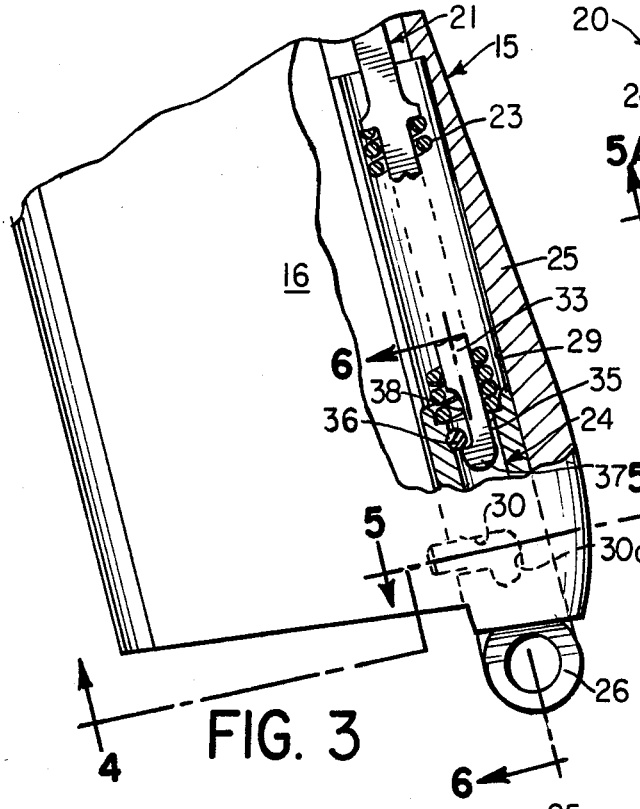
FIG. 3 is a partial sectional view of the pistol handle.

In FIGS. 1–6, pistol 10 includes frame 11, barrel 12, slide 13, slide release lever 14, handle 15, grip panel 16, trigger 17 and trigger guard 18. Also shown are magazine 20, hammer strut 21, strut spring 23, cylindrical mainspring housing and lanyard loop body 24 and lanyard loop 26. As assembled, strut 21, mainspring housing/lanyard loop body 24, and mainspring 23 comprise strut loop body unit 28 (see FIG. 2).

The handle portion of frame 12 includes a handle housing 25 in which magazine 20 including magazine base plate 20*a* and magazine walls 20*b* is held during operation of the pistol. Housing 25 includes a curved-wall recess 29 for receiving, holding and permitting partial rotation of mainspring housing/lanyard loop body 24 therein. Housing 25 also includes a bayonet lock recess 30 (see FIG. 2).

Strut 21 includes upper curved hammer-engaging strut portion 31, strut spring ledge 32 and lower spring guide piece 33, all integrally formed. Lower spring guide piece 33 fits telescopically into lanyard body cavity 35 (see FIG. 3) to form a unit 28 operating together during assembly and connected together during disassembly by connecting means as described below. Strut coil spring 23 is located between spring ledge 32 and loop body 24. When mainspring housing/lanyard loop body 24 is locked in frame curved-wall recess 29 it cannot move relative to the frame housing 25 while hammer strut 21 is movable upwardly and downwardly under action of hammer 19 and strut spring 23. Mainspring housing/lanyard loop body 24 carries catch pin 36. Strut section 33 has at its end a hook portion 37 formed due to the presence of strut notch 38 which hook portion 37 engages pin 36 during disassembly as herein described.

Figure 7:
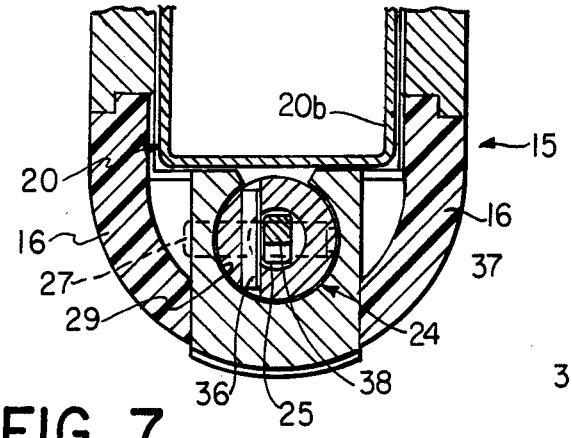
FIG. 7 is a sectional view similar to FIG. 4 showing the mainspring housing/lanyard loop body in locked position.
Figure 9:
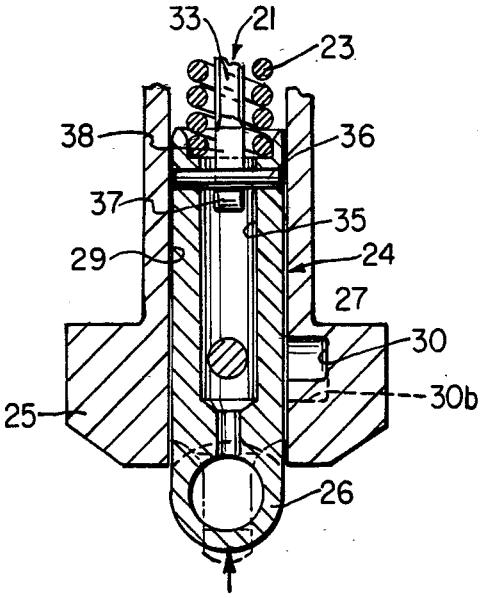
FIG. 9 is a partial sectional view showing the mainspring housing/lanyard loop body strut unit in locked position.
Figure 10:
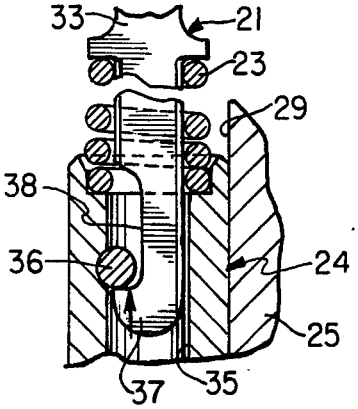
FIG. 10 is a partial sectional view showing the pin attachment arrangement between the hammer strut and the mainspring housing/lanyard loop body.

During normal operation of the pistol, catch pin 36 does not interfere with reciprocation of strut section 33 in body cavity 35. Hook portion 37 bypasses pin 36 (see FIGS. 6 and 7). When the mainspring housing/lanyard loop body 24 and strut 21 are removed during disassembly of the firearm, the magazine 20 is first removed followed by the 90° turning of mainspring housing/lanyard loop body 24 to unlatch it. This 90° rotation of mainspring housing/lanyard loop body 24 causes catch pin 36 to be moved into notch 38 (FIGS. 9 and 10). In its turned position, mainspring housing/lanyard loop body 24 is connected to lower strut section 33 and upon removal from the pistol handle 15 the body 24, mainspring 23, and strut section 33 remain an assembled unit 28 (see FIG. 2).

Figure 5:
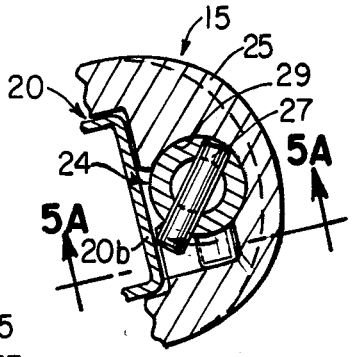
FIG. 5 is a sectional view along line 5—5 of FIG. 3.
Figure 5A:
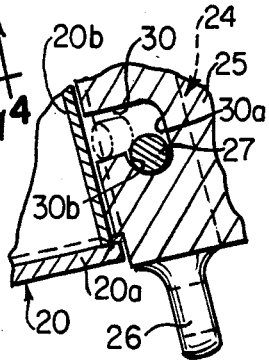
FIG. 5*a* is a partial sectional view showing the magazine adjacent the frame lock recess with the lanyard loop/mainspring housing in locked position.
Figure 4:
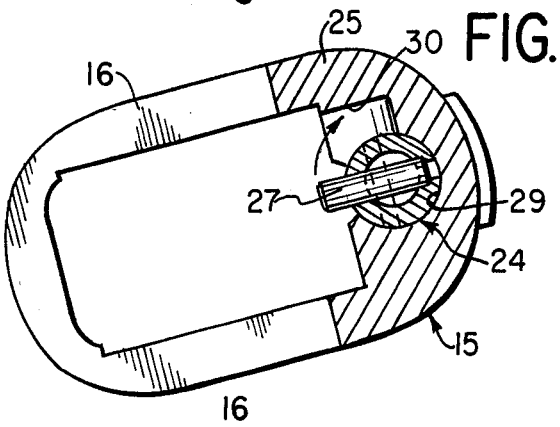
FIG. 4 is a sectional view along line 4—4 of FIG. 3.

Assembly of the pistol 10 requires insertion of unit 28 into curved wall recess 29 and its rotation to engage bayonet lock pin projection 27 in recess 30. The magazine 20 is then inserted. Once magazine 20 has been installed unit 28 cannot be unlatched and removed because bayonet lock pin projection 27 is blocked by magazine wall 20*b* (FIGS. 5 and 5*a*).

Figure 8:
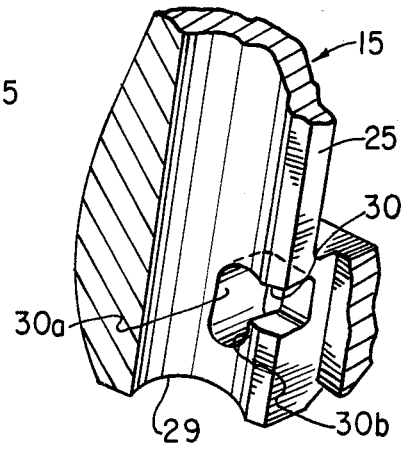
FIG. 8 is a perspective view of a portion of the handle frame showing the bayonet joint recess.
Figure 6:
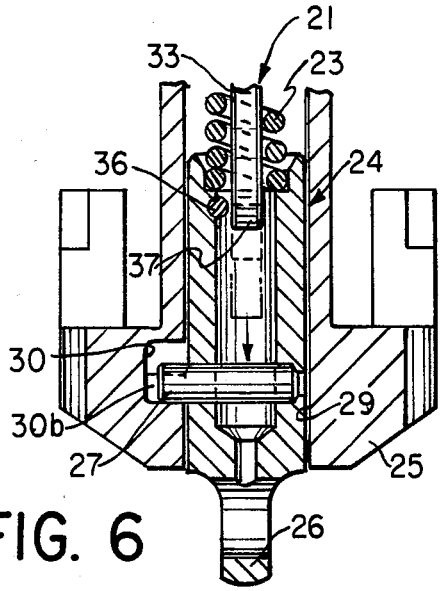
FIG. 6 is a sectional view along line 6—6 of FIG. 3.

In assembly, the mainspring housing/lanyard loop body, mainspring 23, and strut unit 28 are inserted into curved-wall recess 29. Upper strut portion 31 is engaged in or to the hammer 19. In this position, unit 28 including its loop 26 extends slightly more below the handle than in its final assembled position. Unit 28 including loop 26 is then pushed upwardly compressing spring 23 and at the same time is turned to engage bayonet lock pin 27 in bayonet lock recess 30. Lock recess 30 includes lower recess portion 30*a* and recess cam surface 30*b* (see FIGS. 5 and 5*a*). Unit 28 is released allowing spring 23 to lower it until bayonet lock pin 27 seats in lower section 30*a* of recess 30 (see FIG. 5*a* and FIG. 8). During unit 28 disassembly (after magazine 20 removal), unit 28 including loop 26 is pushed upwardly carrying bayonet lock pin 27 also in the upward direction. If during this upward movement pin 27 is restrained by its engagement with hammer 19, loop body 24 and strut 21 will move relative to one another in telescoping fashion permitting loop body 24 to raise far enough for proper unlocking of the bayonet joint 27, 30, and 30*a*. Strut notch 38 is large enough to accommodate sufficient movement of catch pin 36 to accomplish unlocking of unit 28.

Upon removal of unit 28, strut 21, mainspring 23, and mainspring housing/lanyard loop body 24 are held together as a unit to facilitate reassembly and reduce the likelihood of either part being mislaid; yet all parts are visible for inspection and cleaning, which is important for routine maintenance of any pistol.

We claim:

1. In a handgun having a grip frame, a magazine, a hammer, a strut, a spring urging the strut upwardly against the hammer, the improvement comprising (a) a cavity in the grip frame adjacent the magazine;

(b) a lanyard loop/mainspring housing positioned in the frame cavity, said loop housing including a housing recess therein;

(c) a strut extension telescopically positioned in the loop housing recess;

(d) spring means mounted between the strut extension and lanyard loop housing to urge the strut extension and housing apart;

(e) rotatable locking means for locking the loop housing to the frame, said locking means being rotated to a first position for locking and, for unlocking the housing from the frame, said locking means being turned to a second position; and (f) connector means for connecting the lanyard housing and strut extension together when the locking means is in its said second position.

2. The improvement of claim 1 in which the locking means includes a projection on the lanyard loop/mainspring housing and a locking recess in the frame and in which movement of the lanyard loop/mainspring housing toward the hammer compressing said spring means and rotation of the loop housing in one direction causes the projection to enter the locking recess and in which such loop housing movement toward the hammer and rotation in the opposite direction causes such projection to exit the locking recess.

3. The improvement of claim 1 in which the connector means includes hook means on the strut extension and pin means on lanyard loop/mainspring housing which are engageable when the loop housing locking means is rotated to its second unlock position.

4. The improvement of claim 2 in which the locking means projection on the loop housing is blocked from exiting the locking recess by the magazine.

* * * * *